United States Patent [19]

Semar

[11] Patent Number: 4,542,788

[45] Date of Patent: Sep. 24, 1985

[54] DOWNHOLE WELL TOOL

[76] Inventor: Jim Semar, 109 East Dr., New Iberin, La. 70560

[21] Appl. No.: 602,820

[22] Filed: Apr. 23, 1984

[51] Int. Cl.[4] ..... E21B 23/04

[52] U.S. Cl. ..... 166/217; 166/212

[58] Field of Search ..... 166/217, 212, 206, 179, 166/120, 238, 182, 192

[56] References Cited

U.S. PATENT DOCUMENTS

| | | | |
|---|---|---|---|
| 1,671,223 | 5/1928 | Britton | 166/179 |
| 1,842,116 | 1/1932 | Rasmussen | 166/120 |
| 2,287,319 | 6/1942 | Miller | 166/217 |
| 2,358,466 | 9/1944 | Miller | 166/217 |
| 2,695,064 | 11/1954 | Ragan et al. | 166/120 |
| 4,352,394 | 10/1982 | Zehren | 166/120 X |

*Primary Examiner*—James A. Leppink
*Assistant Examiner*—Hoang C. Dang
*Attorney, Agent, or Firm*—Gunn, Lee & Jackson

[57] ABSTRACT

For use in servicing a completed well exposed to the possibility of upward flow, an improved tool is set forth in the preferred and illustrated embodiment. This tool is adapted to be run on a wireline to support wireline service equipment therebelow; it incorporates a set of weights which are affixed to a sleeve, the sleeve connecting with a set of serrated collet slips on a tapered cone. The tapered cone is connected with a central rod or stem which extends therebelow, telescoping in the sleeve, the two being forced to telescope by a coil spring. At the top end, the cone is connected with a fishing neck and rope socket to enable the device to be run on a wireline. If flow from the bottom of the well occurs, the tool is forced to an expanded position and thereby sets, substantially blocking the passage to limit fluid flow pass the tool.

5 Claims, 3 Drawing Figures

FIG. 1
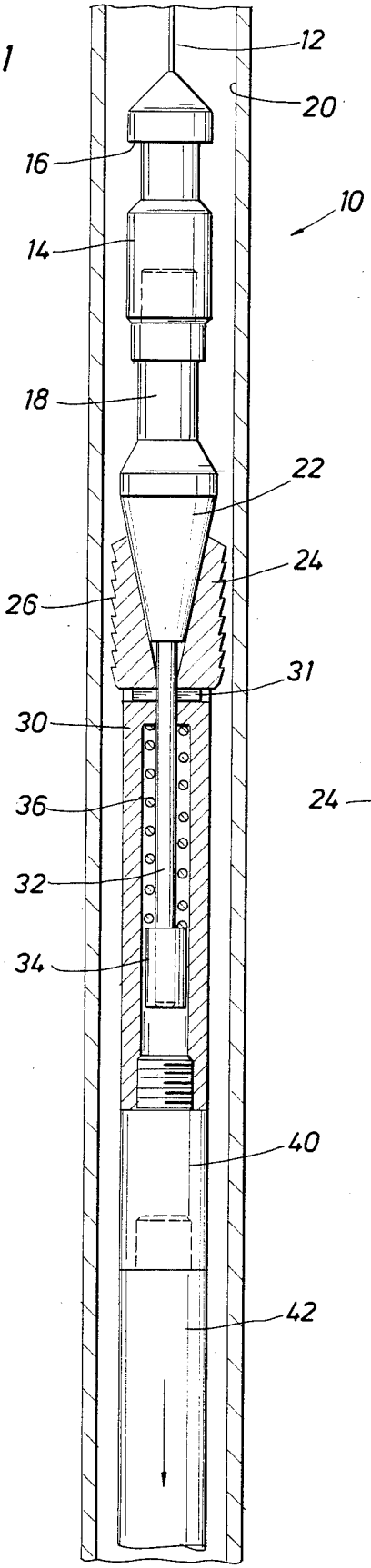
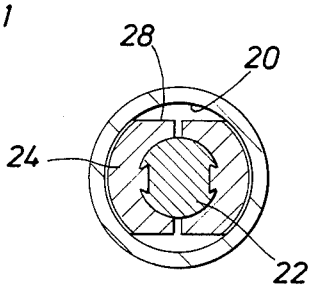
FIG. 3
FIG. 2
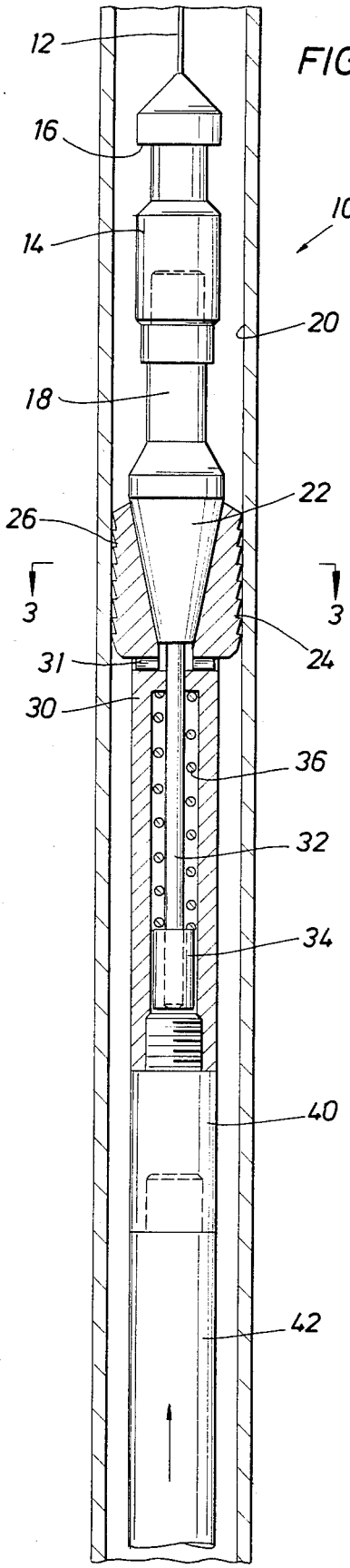

DOWNHOLE WELL TOOL

BACKGROUND OF THE DISCLOSURE

Assume that a completed well requires servicing. The typical servicing routine is to place a wireline in the tubing string with suitable remedial tools affixed to the wireline. Typically, the wireline is run through the wellhead equipment at a lubricator or stuffing box, all for the purpose of holding back the pressure and to thereby enable the wireline and associated tool to be lowered into the tubing string. There is a calculated risk in the use of a lubricator or stuffing box, and it is possible for pressure surges flowing up the tubing string to blow the remedial tool and wireline back toward or through the wellhead equipment. This is dangerous to the personnel and equipment. When the tools are forced upwardly, they may overrun the wireline and get tangled in it. This leads to snarled wireline and difficult fishing jobs.

The present apparatus is a type of catch mechanism adapted to be incorporated with a fishing tool. The particular remedial tool is not particularly important, and this apparatus can be used with many types of wireline operated remedial tools such as a bottom hole pressure recorder. As an example, tools which are typically manipulated from a wireline can be installed with the present invention. Such an installation as contemplated by this disclosure involves a conventional wireline which is extended into a tubing string, terminating at a rope socket having a conventional neck thereon. The present apparatus is located just below the finishing neck and is typically above the remedial tool. This enables this apparatus to be positioned close to the remedial tool so that any pressure surge encountered flowing upwardly through the tubing string will catch this apparatus and move it upwardly. It moves only slightly; the slight move is associated with setting the present apparatus so that further movement is prevented. That is, this apparatus includes tapered slips which ride on the exterior of a tapered cone, and the slips expand radially outwardly to lock against the surrounding tubing. There is some space between the tool and the tubing to enable some blow by, thereby reducing flow volume and constricting the flow upwardly through the tubing string. In effect, the apparatus prevents remedial tools from being blown up through the tubing string into the Christmas tree. Moreover, controlled flow permits the pressure flow from below the tool to set the tool and the controlled flow can be more readily handled by the equipment located at the wellhead. The controlled rate of flow pass this apparatus typically constricts but does not fully plug the tubing string, and is therefore desirable to prevent dangerous blowouts through the tubing string.

This apparatus is particularly described as a tethered tool run in tubing having a rope socket and conventional fishing neck on the top end. They are integrally joined with a cone therebelow, the cone cooperating with serrated slips which set and hold the tool when actuated. This tool is particularly helpful in supporting a cooperative remedial tool therebelow. The device is particularly advantageous in that an upward pull on the wireline unsets the device. The device is set by upward fluid flow. So long as the device supports substantial weight on the wireline, it can travel down the tubing string in an unset condition. An upward pull, whether the tool is moving upwardly or downwardly, maintains the device in a released condition. Therefore this does not interfere with running the tool into a tubing string. Moreover, it is supported on a wireline along with a number of weights. The number of weights can be changed to accommodate the size, weight and length of the remedial tool supported therebelow. Spring tension setting can be varied to also adjust the tool.

One important use of the tool is to prevent loss if the wireline breaks. The tool will set and snag a collar if the wireline breaks; the tool will not fall to the bottom of the tubing.

With the foregoing in view, this apparatus is summarized as a tool adapted to be run on a wireline which chokes but does not totally restrict a blowout from downhole. The tool is comprised of a rope socket having a conventional fishing neck and an integrally attached tapered cone therebelow. It supports in a spring arrangement, a telescoped stem and sliding sleeve thereabout. The sleeve is adapted to be connected to the fishing tool with suitable weight bars therebetween to adjust the position of the slips and tapered cone.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through the wireline tool of this disclosure suspended on a wireline in a tubing string and having a set of weights therebelow, the device being retracted so that it runs easily in a tubing string;

FIG. 2 is a view similar to FIG. 1 showing the expansion of the collet fingers on the cone to grip the tubing string to prevent upward movement; and FIG. 3 is a sectional view along the line 3—3 of FIG. 2.

DETAILED DESCRIPTION OF THE PREFERRED EMBODIMENT

Attention is first directed to FIG. 1 of the drawings. In FIG. 1, the safety tool of this disclosure is identified by the numeral 10 and is supported on a wireline 12. The wireline connects with a rope socket 14 which has a fishing neck 16 at the upper end constructed in accordance with industry standards. There is an elongate tubular section 18 therebelow and it terminates in a threaded connection with the rope socket. The entire apparatus is adapted to be placed in a tubing string 20. The stem 18 connects with a tapered cone 22. It has an enlargement at the upper end and a conic shaped facing surface which tapers to a narrow lower end. The tapered conic surface is a tapered area which cooperates with a set of slips 24. They are better shown in FIGS. 1 and 3 considered jointly. On the exterior, they include serrated upwardly facing teeth 26 which take a bite into the tubing to prevent upwardly slippage. Moreover, the slips are formed of a pair of members having a cylindrical outer face with teeth 26. As shown in FIG. 3, a bypass passage is included by truncating the slips at 28 to define a flowby passage. The slips are equipped with mating faces on the interior contacted against the cone 22 for telescoping movement which initiates radial expansion. The radial expansion drives the serrated teeth 26 into the tubing string. The slips are guided by a dovetail and guide protruding into the dovetail as shown in FIG. 3.

The serrated slips are affixed at the upper end of a tubular sleeve 30. They are supported on the sleeve 30 for deflection. That is, the contrast between FIGS. 1 and 2 shows the slips (each one encompassing about 180° of arc) to deflect inwardly or outwardly as the case may be in a dovetail slot 31 cut along a diameter of the sleeve 30. They are preferably joined to the sleeve 30 by means of an enlarged head on a tab, the head fitting in the dovetail slot and being wider than the slot to lock into the slot 31. The sleeve 30 supports the slips for radial movement between the positions of FIGS. 1 and 2.

The cone 22 supports a downwardly extending stem 32. The stem 32 terminates at an enlargement 34 which preferably threads to the stem. It has an upwardly facing shoulder on it, and a coil spring 36 is captured above the shoulder. The coil spring 36 forces the sleeve 30 upwardly relative to the stem 32. As best shown in the contrast between the two views, the coil spring is received on the interior of the sleeve and contacts against the lower face at the inside of the sleeve. The sleeve is forced upwardly and moves the slips 24 into contact with the cone 22, and hence expansion for holding the tool in the tubing 20. This contrast is shown by the relative diameter of the slips 24 as they move radially outwardly into a gripping position in FIG. 2.

The sleeve 30 is hollow and has an axially drilled hole enabling the stem 32 to extend through it. On the interior, it is counterbored to a diameter sufficient to receive the nut 34 at the lower end of the stem 32. This internal cavity has a length sufficient to permit the stem 32 to move downwardly as shown in FIG. 2. At the maximum downward extension, the stem 32 still has sufficient room to enable the stem to be properly positioned for manipulation of the slips on radial expansion.

The sleeve 30 terminates at an internal tapped opening to enable a weight bar 40 to be threaded to the lower end. An additional weight bar is attached at 42. The weight bar 42 terminates at a suitable threaded connection for support of a suitable remedial tool, such tool being omitted from the drawings. The remedial tool is the apparatus which is supported by the present apparatus. That is, it is a tool adapted to be located on the lower end of the equipment for the purpose of conducting well operations of a particular nature and description to meet some particular need. As an example, the well tool may well include a pressure measuring device, perhaps a perforating tool, some type of setting tool and the like. A great variety of tools can be attached. Any such tool for remedial work in the tubing string is attached below the weights 40 and 42 by threaded connection to them. When threaded connection is completed, the remedial tool is then supported below the safety tool of this disclosure and all of that equipment is then supported on the wireline to enable the equipment to be suspended in the tubing string.

Operation of the device should be considered. Assume for easy description that the well has a nominal pressure of 5,000 psi at the wellhead. Assume further that the bottom hole pressure is more than 10,000 psi, and that the formation can produce sufficient fluid to sustain a very significant flow up the tubing string. In that instance, the tubing in the well terminates at wellhead apparatus which includes a suitable stuffing box or lubricator. The apparatus of the present invention is placed in the tubing string in a conventional procedure and is supported in the tubing string on the wireline. When supported in the tubing string, the tool of this invention including the remedial tool supported by it can then be lowered. Assume that upward flow is nominal. That is, the upward flow rate is sufficiently low that the weights carry the wireline supported equipment downhole with reasonable dispatch. As long as this occurs, the wireline is supporting weight and the tools on the wireline are lowered with the wireline sustaining tension.

When a particular upward flow rate is encountered, this tool responds to the upward flow. Assume that a large pressure surge flows up the tubing string. Assume further that a leak occurs at or near the stuffing box. With such a leak, the flow up the tubing string will increase markedly. As this flow increases, the device of this invention is forced upwardly by the dynamics of the pressure surge up the tubing string. This tool constricts flow; flow is not plugged but it is retarded or choked. Choking of the flow restricts the damage done by such a pressure surge. That is, the upward surge of fluid will flow pass the safety tool 10 but the flow is restricted and hence upward movement is not catastrophic. The tool does move upwardly slightly. Such movement is accompanied by radial expansion of the serrated slips which come into gripping relationship with the tubing. This is accomplished when the sleeve 30 rises. Conversely, the stem relatively moves downwardly. This is associated with locking of the tool at a particulat elevation whereupon further upward sliding is prevented. When this occurs, the safety tool 10 and the supported remedial workover tools therebelow are all held in the tubing string and blowout is prevented.

The apparatus of this disclosure is particularly effective when being run into the tubing string. When the tool is being lowered at a rate of several hundred feet per minute, any sizable upwardly flow will tend to set the tool and stop downward movement. Conversely, after it has been set the tool can be nevertheless retrieved quite easily by simply pulling upwardly on the wireline. When the wireline is pulled, it disengages the tool from the tubing by pulling the serrated slips inwardly. As the slips are moved inwardly, the tool then moves upwardly and can be easily retrieved on a wireline. Wireline retrieval particularly is accomplished by disengaging the tool 10 from the tubing sidewall so that the tool is released and retrieval is possible. This upward movement of the tool enables the tool 10 to be retrieved in tethered fashion on the wireline. Setting is thus accomplished by an upward surge of pressure; release is accomplished by simply pulling upwardly on the wireline.

As will be understood, the foregoing describes the manner of operation. Certain adjustments can be made in the device as for instance by changing the total weight of the weights 40 and 42. Spring tension can be changed by either replacing the spring 36 or alternately moving the adjustment nut 34 upwardly or downwardly. The diameter of the slips 24 can be changed as by removable serrated collets, and substituting those which are dimensioned differently to enable the tool to be used in a different sized tubing string. The passage 28 can also be partially constricted but it is desirable that some flow path be open at all times. Thus, the path at 28 is the desirable configuration to prevent the tool from taking too firm a position in the tubing string.

While the foregoing is directed to the preferred embodiment, the scope is determined by the claims which follow.

What is claimed is:

1. A safety tool for running in a tubing string which comprises:

(a) a rope socket at the upper end which socket is adapted to be lowered in a tubing string on a wireline;

(b) a tapered cone below said rope socket;

(c) externally serrated tubing grip means slidable on said tapered cone and having an external surface for gripping the interior of a tubing string when moved radially outwardly adjacent to said tapered cone;

(d) an elongate connector means extending from said grip means downwardly of the tool;

(e) weight means attached to said elongate connector means for supporting a remedial wireline operated tool therebelow to be run into the tubing string; and (f) a stem for mounting said tapered cone relative to said elongate means enabling relative movement between said stem and said elongate means which movement is coupled to said tapered cone and grip means for radial expansion outwardly into a gripping relationship with the interior of the tubing string.

2. The apparatus of claim 1 wherein a fishing neck constructed in accordance with industry standards is on the rope socket and faces upwardly to enable fishing to retrieve the apparatus.

3. The apparatus of claim 1 wherein said rope socket is adapted to be connected with a wireline extending through the tubing whereupon pull on the wireline moves the tapered cone, causing the trip means to release connection with the tubing string.

4. The apparatus of claim 1 including a coil spring captured between said stem and said elongate means and bearing against a shoulder on each thereof, said spring initiating telescoping movement between said stem and said elongate means.

5. The apparatus of claim 1 wherein said elongate means terminates at a lower threaded connection which is adapted to be connected with a mating threaded connection for affixing a weight thereto.

* * * * *